United States Patent [19]

Nail

[11] Patent Number: 4,782,914

[45] Date of Patent: Nov. 8, 1988

[54] SAFETY GUARD RAIL FOR SCAFFOLDING

[76] Inventor: Donald E. Nail, 2704 NE. 114th St., Vancouver, Wash. 98686

[21] Appl. No.: 137,408

[22] Filed: Dec. 22, 1987

[51] Int. Cl.[4] ..... E04G 1/26

[52] U.S. Cl. ..... 182/113; 182/179

[58] Field of Search ..... 182/113, 179, 178; 52/638

[56] References Cited

U.S. PATENT DOCUMENTS

| | | | |
|---|---|---|---|
| 2,431,933 | 12/1947 | Hartmann | 182/179 |
| 3,084,761 | 4/1963 | Robertson | 182/179 |
| 3,231,043 | 1/1966 | Brown | 182/113 |
| 3,312,305 | 4/1967 | Waun | 182/113 |
| 3,382,949 | 5/1968 | Bloch | 182/113 |
| 3,752,262 | 8/1973 | Helms | 182/113 |
| 3,854,552 | 12/1974 | Kensrue | 182/179 |

*Primary Examiner*—Reinaldo P. Machado

*Attorney, Agent, or Firm*—Olson and Olson

[57] ABSTRACT

A conventional construction scaffolding comprises sections formed of a pair of laterally spaced apart, vertically extending upright members secured in proper position by a cross brace assembly. An adjustable safety guard rail assembly therefor comprises a vertically spaced apart pair of bars pivotally and permanently attached to the cross brace members, the upper guard bar being pivotally connected intermediate its opposite terminal ends to a cross brace member and the lower guard bar being pivotally connected at one of its terminal ends to a cross brace member, the opposite end of the lower bar being connected slidably to the other cross brace member, to slide freely on the latter for accommodating variations in the spacing between the upright members of the scaffolding. The upper guard bar pivotally mounts a sleeve channel member on each of its terminal ends, the sleeve members configured to engage the uprights at one of the steps on the upright to lock the upper bar in place extending horizontally between uprights to obstruct the open spaces between the cross brace assemnbly and the flooring of the scaffold.

7 Claims, 2 Drawing Sheets

SAFETY GUARD RAIL FOR SCAFFOLDING

BACKGROUND OF THE INVENTION

This invention relates to temporary scaffolding used, for example, in the construction industry, and more particularly to a safety guard rail for conventional scaffolding arranged to obstruct the open spaces between the scaffolding side cross braces in order to prevent persons working on the scaffolding from inadvertently falling therethrough.

In typical scaffold constructions, two spaced apart upright members are secured in proper upright position by side cross braces, and floor boards are extended between uprights and set upon supports provided on each upright so that workmen can stand and work on the stable, elevated, temporary flooring. However, it has been experienced that workers can, for one reason or another, fall through the unprotected open space between the floor and the crossed braces on the sides of the scaffolding. This has resulted in serious injury, and consequently, OSHA a federal regulatory and safety agency, has imposed new regulations on the industry that require suitable safety rails be installed on the scaffolding to obstruct the open spaces between the cross bracing.

However, because of the guard rail constructions provided heretofore in the art, installation of safety rails is oftentimes difficult, time consuming and frustrating because of typical, minor dimensional variations in scaffold constructions. Consequently it is common that workmen simply ignore the installation of safety guard rails, despite the federal requirements for their installation.

SUMMARY OF THE INVENTION

In its basic concept, this invention provides a scaffolding safety guard rail which is configured for adjustable attachment to the standard cross brace assembly of conventional scaffolding, the guard rail configured to interrupt the open space between the cross brace assembly and the flooring of the scaffolding.

It is by virtue of the foregoing basic concept that the principal objective of this invention is achieved; namely, the provision of permanently attached safety rails for scaffolding that are automatically positioned when a scaffolding is erected so that the heretofore typical occurrence of ignoring the installation of conventional safety rails is obviated, and accordingly the workers in the industry are better protected and Federal safety regulations are observed.

Another object of this invention is the provision of a scaffolding safety guard rail of the class described which, together with the conventional cross members of a scaffold, folds into a collapsed, unitary condition for convenient and efficient storage and transport between uses.

A further object of this invention is the provision of a scaffold safety guard rail of the class described which accommodates installation on the scaffolding despite typical dimensional variations common in conventional scaffold constructions.

A still further object of this invention is the provision of a safety guard rail of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
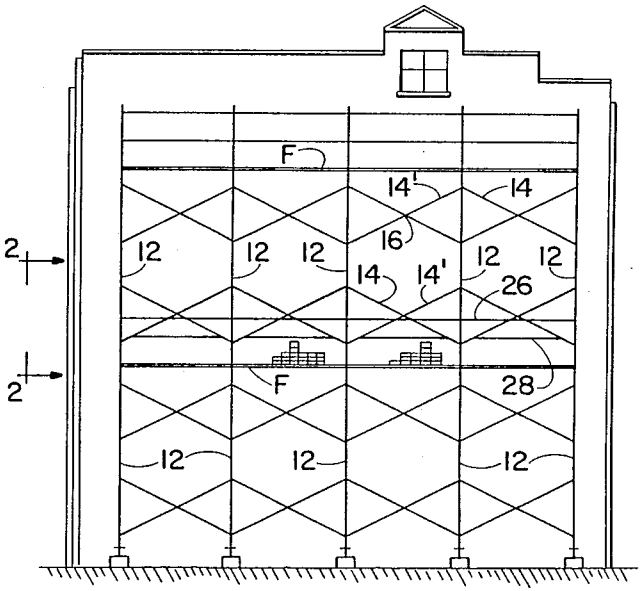
FIG. 1 is a schematic front elevation of a conventional scaffolding mounting the safety guard rail of this invention, the scaffolding erected adjacent to a building under construction as is typical in the industry.

This invention provides a vertically spaced pair of safety guard rails for scaffolding typically used in the construction industry, such as that illustrated in FIG. 1 of the drawings. The horizontally extending guard rails of this invention are disposed, in the embodiment shown in FIG. 1, above the working level approximately midway between the ground and the uppermost floor level of the scaffolding.

Figures 3, 4, 5:
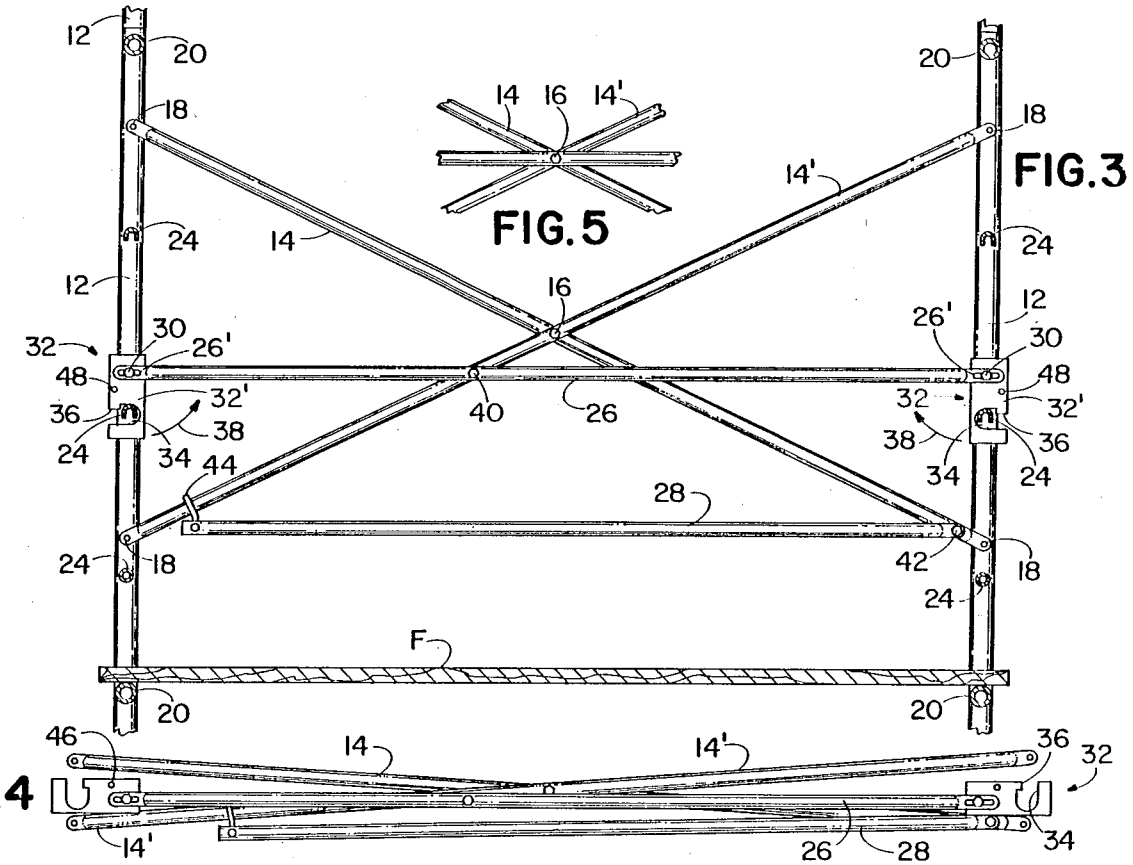
FIG. 3 is a fragmentary side elevation of the scaffolding of FIG. 2, as viewed from the confines of the scaffolding looking out, the view taken along the line 3—3 in FIG. 2.
FIG. 4 is a side elevation of the unitary cross member and the guard rail assembly shown in collapsed, inoperative position.
FIG. 5 is a fragmentary front view of the central portion of a pair of scaffold cross braces with the upper safety rail of this embodiment being attached by the cross brace pivot.

Construction scaffolding of this type is standardized in the industry, and comprises a laterally spaced apart pair of inverted U-shaped uprights each having a work facing rear side 10 and an outward facing front side 12. The uprights are secured in upstanding position by cross brace assemblies 14, 14' interconnecting opposite uprights on each side 10, 12. As shown in FIG. 3, the cross brace members are joined together at their center by a bolt or other pivot means 16, and their terminal ends are releasably secured, as by bolts 18 to the corresponding sides 10, 12 of opposite uprights as shown. Thus, the large scaffold construction shown in FIG. 1 is achieved by providing additional laterally spaced uprights and securing them by cross brace members 14, 14' to one of the already positioned and cross braced uprights, and repeating this installation until the scaffold is as long as desired. Increasing the height of the scaffolding is accomplished, as is known in the art, by connecting uprights together vertically on top of lower, secured uprights, and providing the cross bracing to opposite sides as is shown in FIG. 1.

Figure 2:
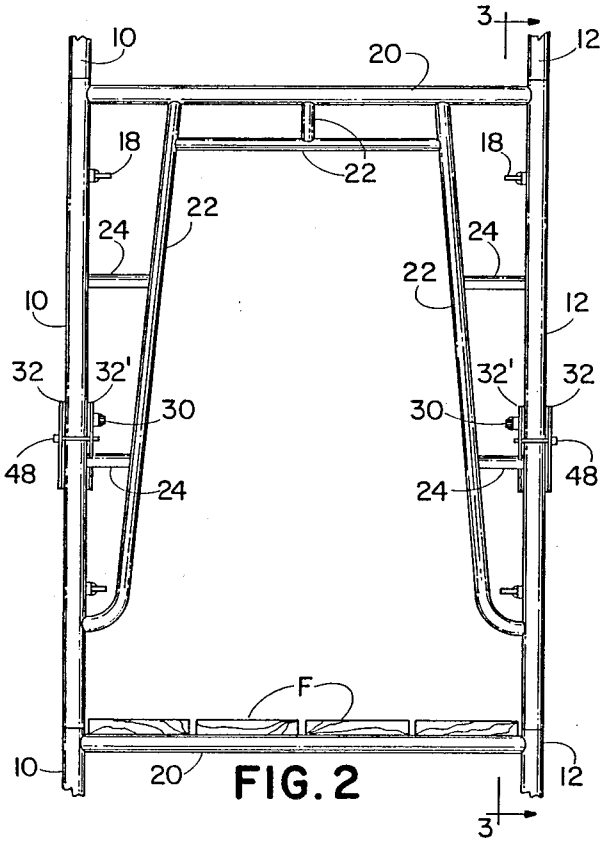
FIG. 2 is a fragmentary end view of the scaffolding of FIG. 1, taken along the line 2—2 in FIG. 1.

Floor boards F are provided to span between uprights, the boards being supported on a cross member 20 which forms the interconnecting cross piece of the U-shaped upright, joining the opposite sides 10, 12 together as seen best in FIG. 2. Each upright includes a strengthening structure 22 (FIG. 2) which includes rungs 24 which are typically used by workmen as steps in climbing to various floor levels.

The preceding has detailed scaffolding construction that is recognized as typical in the art. Such scaffold uprights and cross braces utilize standard configurations and, as such, are uniform in the industry. Although minor variations in dimensions and the like may exist between manufacturers' scaffoldings, and variations may occur from one installation to another, these variations are relatively small, and do not often result in more than simple inconvenience in assembling scaffolds. However, greater difficulty has been experienced when installing conventional safety guard rails because the limited guard rail configurations now available do not accommodate the typical dimensional variations just discussed.

The safety guard rail of this invention provides a pair of bars 26, 28 that are pivotally attached to the cross brace structure 14, 14' of the scaffolding, and remain so attached, preferably permanently, so that installation of the cross brace assembly during erection of the scaffold automatically positions the guard rails for attachment.

Referring primarily to FIG. 3 of the drawings, wherein only the front facing side 12 of the uprights are shown, an upper safety guard rail 26 is dimensioned to span the distance between a pair of scaffold uprights 12. This safety rail is mounted pivotally at its opposite ends by pivot connections such as bolts 30 extending through longitudinally elongated slots 26' in the safety rail, the bolts mounted on channel members 32 configured to capture the spaced apart scaffold uprights 12. Each channel member, or sleeve, is U-shaped in cross section and is configured to slip freely over the scaffold upright as shown. Its lower end is provided, on its closed, intermediate wall 32', with a notch 34 configured to removably receive one of the step rungs 24 provided in the frame sections of the scaffold uprights 12. A projecting tab 36 is provided to partially close the notch as shown to releasably lock the sleeve against inadvertently slipping or pivoting in the direction shown by arrow 38 off of the step. Lateral movement of course is prevented by the upright 12 being captured within the confines of the channel.

As illustrated best in FIG. 3 of the drawings, the upper safety rail 26 of this invention engages one of the cross brace members 14' at the point at which the rail 26 crosses the brace member 14'. In the embodiment illustrated, the safety rail is connected pivotally by a bolt 40 to the cross brace member 14'. Alternatively, if desired the pivot connection 40 could be disposed to the right along the rail 26 and positioned to connect the cross brace member 14 to the guard rail 26 instead of cross member 14'.

Accordingly, it is understood that the safety rail 26 is pivotally connected to one of the cross brace members 14, 14', and mounts at its opposite terminal ends, mounting means, illustrated in this embodiment as channel sleeve members 32 which are configured to engage the uprights 12 and one of the steps 24 associated with each upright. In this manner, the guard rail is automatically positioned for installation after the cross brace members have been secured during erection of the scaffolding, and actual installation of the guard rail involves only placing the sleeves 32 into engagement with the uprights and pivoting them to engage the step, thus locking the safety rail in place.

A second, lower guard rail 28 is also provided, this guard rail being configured for attachment of one of its terminal ends to one of the cross brace members adjacent its lower terminal end. In this embodiment, the terminal end of guard rail 28 is pivotally attached, as by bolt 42, to the cross brace member 14 near its lowermost terminal end where the brace member is connected to the upright 12. The opposite terminal end of the guard rail 28 mounts a ring 44 which is configured to freely engage the lower portion of cross brace member 14' and allow the latter to slide freely therethrough. In this manner, the lower guard rail 28 is always attached to the cross brace assembly 14, 14', and is automatically positioned as soon as the cross brace members are connected during the assembly of the scaffolding. Minor spacing variations between upright members 12 are accommodated by the adjustable, sliding connection of the guard rail 28 to the cross brace assembly by virtue of the sliding mount 44.

From the foregoing it is understood that the present invention provides a set of safety guard rails which are each pivotally, and preferably permanently, attached to the cross brace assembly so that installation of the cross braces onto scaffolding uprights automatically positions the lower guard rail appropriately, and places the upper guard rail into a position whereby its installation requires only slipping the end members 32 into position against the uprights and into engagement with the step rungs 24 associated with each upright. In the embodiment illustrated, the safety guard rails are positioned at approximately 22 inches and 42 inches, respectively, above the floor board surface F.

In the alternative shown in FIG. 5 of the drawings, the upper guard rail 26 is pivotally attached to the cross brace assembly 14, 14' at the pivot 16 of the cross brace assembly, using a pivot bolt of sufficient length for the purpose. This eliminates the pivot connection 40 of the earlier described embodiment. It will be understood that, with the upper guard rail being disposed slightly higher, the sleeve members 32 in this embodiment are configured longer, to elevate the terminal ends of the safety guard rail the appropriate greater distance above the step 24 to maintain the safety rail in a horizontal position in the same plane of the pivot connection 16.

FIG. 4 illustrates the cross brace assembly with the safety guard rails of this invention attached thereto in collapsed condition when not in use. As is shown, the entire assembly folds into a condition which is substantially no more bulky or cumbersome than is the cross brace assembly alone. Accordingly, during installation, each scaffold section can be assembled as a whole, with only one unitary assembly being handled, rather than a plurality of individual parts requiring individual assembly during the construction of each section of a scaffold.

The assembly of a scaffold section having the safety guard rail assembly of this invention attached to the cross brace assembly as previously described, is as follows: A pair of uprights are positioned in appropriately spaced apart, vertically extending condition, and the cross brace assembly is lifted into position where the upper terminal ends of the cross brace members 14 and 14' may be bolted to one or both of the upright sides the uprights as shown at 18 in FIG. 3. In so doing, the cross brace assembly scissors out to a position in which the bottom terminal ends of the cross brace members 14 and 14' may be bolted in place on the uprights. As the cross brace members pivot about their pivot connection 16, the lower safety guard rail 28 pivots about its anchor 42 to the cross member 14, and the opposite end of the safety rail allows the other cross member 14' to move and pivot by virtue of the sliding attachment of the guard rail thereto by the sliding ring connection 44. With the cross brace assembly thus mounted, the lower guard rail has automatically been moved into the functional position of FIG. 3.

The upper guard rail is then manipulated about its pivot connection 40 on cross brace 14' to position one U-shaped channel sleeve member 32 to straddle and capture one upright 10, 12 between the projecting legs of the channel. The channel is then pivoted, about bolt 30, downwardly so that the notch 34 slips over the step 24 in the upright, whereupon the sleeve will drop slightly and the step is captured within the notch 34 and locked in place by the projecting tab 36. The other sleeve is attached to the other upright in the same manner. The longitudinally extending slots 26' provided in the opposite terminal ends of the safety guard rail 26, through which the mounting bolts 30 pass to secure the guard rail to the end sleeve members 32, accommodate the typical variations in distance between uprights and facilitates connection of the sleeve members to the uprights.

If desired, each sleeve member 32 may be provided with aligned openings 46 adjacent its spaced ends, for reception of a safety pin 48 by which to prevent inadvertent detachment of the sleeve member from the scaffold upright 12 in the event the guard rail 26 is removed from the sleeve members.

From the foregoing it will be apparent to those skilled in the art that the typical installation of the safety guard rails of this invention requires substantially only the single, simple step of slipping the end sleeves 32 into engagement with the upright members. The lower guard rail 28 is positioned and secured automatically and without attention simply by installing the conventional cross brace assembly in the conventional manner. Moreover, the upper guard rail is carried into position and held while the conventional cross brace assembly is being installed.

Accordingly, it will be readily apparent that the present invention provides a set of safety guard rails that conform to federal regulations and are extremely easy to install, and require little, if any, additional effort or time to install over that which is normally spent in simply erecting a scaffolding section. The result is that not only is the difficulty in installing safety guard rails eliminated, but by virtue of their permanent attachment to the cross brace assembly, the lower guard rail is automatically positioned, and the upper guard rail must be positioned and locked in place, for otherwise the workmen will find it extremely inconvenient to have a freely pivoting upper guard rail bar hanging in their way. The end result is that workmen are encouraged to install the guard rails so that they don't obstruct their work, and the installation is desirable to the workmen because of its simlicity.

From the foregoing it will be apparent that various changes other than those already described may be made in the size, shape, type, number and arrangement of parts described hereinbefore without departing from the spirit of this invention and the scope of the appended claims. For example, the pivot point 40 may comprise a sliding ring attachment if so desired, or the pivot point 40 may be fixed as illustrated and a sliding ring attachment such as connection 44 may be provided on the guard rail 26 and disposed to engage the cross member 14 if so desired to restrain the pivoting of the guard rail 26 prior to the attachment of the sleeves 32 on the uprights. Also, the various different pivot and sliding connections illustrated herein may be reversed or substituted one for another, or other, similar connection means as may be suitable may be substituted therefor. Additionally, the pivot connections of the guard rails to the cross braces and sleeve members may be of a type that is not detachable, whereby the intentional or inadvertent removal of one or both guard rails is avoided.

Having thus described my invention and the manner in which it may be used, I claim:

1. In combination with a scaffold having at least one pair of horizontally spaced apart, vertically extending uprights and a supporting cross brace assemby including a pair of elongated brace members pivotally connected intermediate their longitudinal ends and connected detachably at their opposite terminal ends to said pair of opposite uprights to secure the latter in upstanding position, a safety guard rail assembly configured to obstruct the open spaces between a scaffold floor and the crossed bracing, comprising:

(a) a longitudinally elongated guard rail mounted pivotally at one of its terminal ends to one cross brace member, and (b) a slide ring connector mounted adjacent the opposite terminal end of said guard rail and freely engaging and being carried by the other cross brace member of the pair, the guard rail extending substantially horizontally between the pair of cross brace members.

2. The combination of claim 1 including:

(a) a pair of opposite sleeve members each configured to releasably engage opposite uprights to secure the sleeve members in position thereon, (b) a second longitudinally elongated guard rail mounted pivotally intermediate its terminal ends to at least one cross brace member vertically above said first named guard rail, and (c) pivot connector means on each said sleeve member configured to pivotally mount opposite terminal ends of said second guard rail to said opposite sleeve members, whereby to releasably secure the second guard rail in substantially horizontal position between the pair of uprights.

3. The combination of claim 2 wherein the second guard rail is mounted pivotally to the cross brace members by the common pivot connecting the cross brace members pivotally together.

4. The combination of claim 2 wherein said pivot connector means mounting the opposite terminal ends of the second guard rail to opposite sleeve members comprises a bolt, and at least one opposite terminal end of the second guard rail includes a longitudinally elongated slot through which said pivot bolt extends, whereby longitudinal adjustment of the guard relative to the sleeve member may be made to accommodate variations in the spacing between opposite uprights engaged by the sleeve members.

5. The combination of claim 2 wherein said sleeve members are each configured with a notch configured to engage a step rung on an upright to secure the sleeve in position engaging the upright.

6. In combination with a scaffold having at least one pair of horizontally spaced apart, vertically extending uprights and a supporting cross brace assembly including a pair of elongated crossed brace members pivotally connected intermediate their longitudinal ends and connected detachably at their opposite terminal ends to said pair of opposite uprights to secure the latter in upstanding position, a safety guard rail assembly configured to obstruct the open spaces between a scaffold floor and the crossed bracing, comprising:

(a) a longitudinally elongated guard rail extending substantially horizontally between the lower end portions of the pair of crossed brace members, and (b) connecting members at the opposite ends of the guard rail detachably mounting the guard rail pivotally on the lower end portions of the pair of crossed brace members, at least one of the connecting members slidably engaging the associated one of the crossed brace members to allow pivotal collapsing of the pivotally connected crossed brace members and guard rail for transort and storage.

7. The combination of claim 6 wherein at least one of the connecting members comprises a slide ring secured to the guard rail at one end of the latter and freely encircling an associated one of the crossed brace members.

* * * * *